US008104160B2

(12) United States Patent
Wohlgemuth

(10) Patent No.: US 8,104,160 B2
(45) Date of Patent: Jan. 31, 2012

(54) METHOD FOR DEPLOYMENT OF TEMPORARY FENCING

(76) Inventor: Victor Wohlgemuth, Hadashville (CA)

( * ) Notice: Subject to any disclaimer, the term of this patent is extended or adjusted under 35 U.S.C. 154(b) by 0 days.

(21) Appl. No.: 12/948,355

(22) Filed: Nov. 17, 2010

(65) Prior Publication Data

US 2011/0121124 A1 May 26, 2011

Related U.S. Application Data

(60) Provisional application No. 61/263,187, filed on Nov. 20, 2009.

(51) Int. Cl.

| | |
|---|---|
| ***E04H 17/02*** | (2006.01) |
| ***B21D 39/00*** | (2006.01) |
| ***B21D 39/03*** | (2006.01) |
| ***B65H 75/40*** | (2006.01) |

(52) U.S. Cl. ..... 29/428; 29/525.01; 256/40; 256/42; 256/44; 242/403; 242/403.1; 242/557

(58) Field of Classification Search ..... 29/428, 29/525.01; 256/32, 40, 42, 44; 242/396.9, 242/403, 403.1, 423.1, 597, 557
See application file for complete search history.

(56) References Cited

U.S. PATENT DOCUMENTS

| | | | | | |
|---|---|---|---|---|---|
| 639,818 | A * | 12/1899 | Levett | 242/396.6 |
| 2,896,877 | A * | 7/1959 | Vaughn | 242/557 |
| 3,650,492 | A * | 3/1972 | Stum | 242/390 |
| 3,934,655 | A * | 1/1976 | Whistle | 173/46 |
| 4,854,521 | A * | 8/1989 | Farnsworth | 242/419.9 |
| 4,925,435 | A * | 5/1990 | Linklater | 474/101 |
| 4,930,718 | A * | 6/1990 | Lancour et al. | 242/557 |
| 4,946,113 | A * | 8/1990 | Riffle et al. | 242/557 |
| 5,476,234 | A * | 12/1995 | St. Pierre | 242/557 |
| 5,568,900 | A * | 10/1996 | Conroy | 242/557 |
| 5,582,216 | A * | 12/1996 | Smith et al. | 140/107 |
| 5,584,444 | A * | 12/1996 | Farmer | 242/395 |
| 5,632,470 | A * | 5/1997 | Leland | 254/385 |
| 5,709,351 | A * | 1/1998 | Osborn et al. | 242/391.3 |
| 6,016,986 | A * | 1/2000 | Wright | 242/396.9 |
| 6,042,046 | A * | 3/2000 | Beyer, Sr. | 242/559.1 |
| 7,143,971 | B2 * | 12/2006 | Yoder et al. | 242/390 |
| 7,264,195 | B2 * | 9/2007 | Fletcher et al. | 242/557 |
| 2003/0222253 | A1 * | 12/2003 | Langlie et al. | 256/10 |

* cited by examiner

*Primary Examiner* — Jermie Cozart
(74) *Attorney, Agent, or Firm* — Kyle R. Satterthwaite; Ryan W. Dupuis; Ade & Company Inc.

(57) ABSTRACT

A method of deploying temporary fencing includes connecting a first end of spooled fencing wire to a first fencepost, and with the spool rotatably on a vehicle, driving the vehicle toward a second position along a perimeter of an area to be fenced in. During this travel, the rotating spool deploys fencing wire for suspension a distance above ground between the fencepost and the spool. The spool is then removed from the vehicle and mounted on a second fencepost at the second position, thereby suspending the deployed fencing wire between the fenceposts. By mounting the spool onto the second fencepost and leaving deployed fencing wire intact with the remaining spooled wire, time and effort is reduced in later retrieval of the fencing, as there is no need to later re-join a cut length of wire to the spool, or to any wire remaining thereon after the initial fence deployment.

12 Claims, 3 Drawing Sheets

METHOD FOR DEPLOYMENT OF TEMPORARY FENCING

This application claims benefit under 35 U.S.C. 119(e) of U.S. Provisional Patent Application Ser. No. 61/263,187, filed Nov. 20, 2009, which is herein incorporated by reference.

FIELD OF THE INVENTION

The present invention relates generally to agricultural fencing used to segregate areas of land for controlled use, and more particularly to methods and apparatuses for deploying temporary electrical fencing.

BACKGROUND OF THE INVENTION

The practice of intensive or rotational grazing involves moving cattle from one parcel of land to another on an ongoing basis, allowing the cattle to substantially consume all the grass in one area before moving on to another. To close or fence off selected parcels of land, electrical fencing can be deployed on a temporary basis and then later relocated as required. Accordingly, prior art developments have been made to aid in one or both of deployment and retrieval of electric fencing wire.

U.S. Pat. No. 6,016,986 teaches a trailer or carriage towable by an all-terrain vehicle (ATV) that rotably carries a spool of electric fencing wire. After setting a primary fence post, an operator connects the spooled wire to the post and then drives the vehicle along the intended fence line with a brake operating on the spool to play out wire in a controlled manner and connects the wire to subsequent posts around the area to be fenced-in. To later retrieve the fencing, the wire is disconnected from the posts. Having been cut during the erection of the fence, a free end of the wire is joined back to any wire remaining on the spool and the spool is manually rotated to re-wind the wire thereon.

While certainly advantageous in reducing the labour and time involved in re-spooling the deployed wire fencing when it is desirable to take down or relocate a temporary electric fence installation, this prior art solution leaves room for further improvement.

SUMMARY OF THE INVENTION

According to a first aspect of the invention there is provided a method of deploying fencing for temporary use, the method comprising the following steps:

(a) connecting a first end of a length of fencing wire wound on a spool to a first fencepost at a first position along a perimeter of an area to be bordered by the fencing;

(b) with the spool supported on a vehicle and rotatable about a rotational axis of the spool, driving the vehicle away from the first position toward a second position along the perimeter of the area, during which the spool is being pulled away from the first fencepost and rotates on the vehicle to deploy fencing wire from the spool for suspension at a height above ground between the first fencepost and the spool;

(c) removing the spool from the vehicle; and (d) mounting the spool on a second fencepost at the second position along the perimeter of the area to suspend the deployed fencing wire between the first fencepost and a mounted position of the spool on the second fencepost.

By mounting the spool onto the second fencepost and leaving deployed fencing wire intact with the remaining spooled wire, time and effort is reduced in later retrieval of the fencing compared to prior art fencing techniques where the wire is cut from the spool, as there is no need to later re-join the cut end of the wire to the spool or any wire remaining thereon after the initial deployment of the fence. The wire used on the fence remains partially wound on the spool and all times and accordingly can be easily and quickly retrieved by disconnecting the deployed wire from the fenceposts and immediately re-winding the deployed wire onto the spool without first needing to somehow rejoin the deployed wire to the spool.

Preferably there are provided the following additional steps:

(e) leaving the deployed fencing in place suspended between the first fencepost and the mounted position of the spool on the second fencepost for a period of use;

(f) disconnecting the first end of the length of fencing wire from the first fencepost; and (g) rotating the spool in a direction opposite to that in which the spool was rotated in step (b) to wind the deployed fencing back onto the spool.

Preferably step (g) comprises mounting the spool onto a vehicle-supported shaft on the vehicle with the rotational axis of the spool coincident with an axis of the vehicle-supported shaft and rotating the spool about the axis of the vehicle-supported shaft.

Preferably the vehicle-supported shaft is a driven shaft and step (g) comprises mounting the spool on the shaft in a fixed position thereon to prevent relative rotation between the spool and the vehicle-supported shaft and then driving rotation of the vehicle-supported shaft to drive rotation of the spool.

Preferably the vehicle comprises a rotational drive source operable to drive rotation of the vehicle-support shaft.

Preferably step (d) comprises mounting the spool onto a fencepost-supported shaft on the second fencepost with the rotational axis of the spool coincident with an axis of the fencepost-supported shaft, rotating the spool about the axis of the fencepost-supported shaft in a same direction about the rotational axis of the spool as in step (b) to tension the deployed fencing wire between the first fencepost and the mounted position of the spool on the second fencepost, and locking the spool in a fixed position about the axis of the fence-supported shaft.

Preferably the fence-post supported shaft is defined by a releasable spool support detachably mounted to the second fencepost.

Preferably the spool support comprises a locking mechanism operable to selectively lock to the spool in the fixed position about the axis of the fence-supported shaft.

Preferably multiple spool supports are carried on the vehicle for use in deployment of multiple sections of fencing between respective pairs of fenceposts Preferably the vehicle comprises a towable trailer.

Preferably the towable trailer is pulled by an ATV.

Preferably multiple spools of fencing wire are carried on the vehicle for use in deployment of multiple sections of fencing each between a respective pair of fenceposts.

According to a second aspect of the invention there is provided an apparatus for releasably supporting a spool of fencing wire on a fencepost, the apparatus comprising an arm having attachment elements carried thereon proximate one end thereof and a shaft carried thereon proximate an opposite end, the shaft projecting to at least one side of the arm for receiving the spool on the shaft for rotation about an axis of the shaft and the attachment elements being arranged to secure to the arm on a fencepost in a position projecting laterally outward therefrom to support the shaft at a lateral distance from the fencepost.

Preferably the attachment elements comprise an embracing element arranged to embrace about a rear side of the fencepost opposite a front side thereof to which the arm is to project, and a bracing element disposed below the embracing element to engage against the front side of the fencepost at a distance downward from the embracing element.

Preferably the embracing element comprises a hook end extending from the one end of the arm and then turning back along the arm to embrace about the rear side of the fencepost.

Preferably the hook end is defined by a movable body selectively slidable along the arm and lockable at different positions therealong to adjust a distance to which the hook end projects from the one end of the arm to accommodate fenceposts of varying size.

Preferably the bracing element comprises a set of teeth pointing away from the opposite end of the arm where the shaft is carried to engage the teeth into the front side of the fencepost.

Preferably there is provided a locking mechanism operable to selectively lock the spool in a fixed rotational position about the axis of the shaft.

Preferably the locking mechanism comprises a latch carried on the arm for linear displacement into a locking position projecting further to the same side of the arm as the shaft than an unlocking position to engage an end of the latch into an opening in a side of the spool in the locking position to block rotation of the spool.

BRIEF DESCRIPTION OF THE DRAWINGS

In the accompanying drawings, which illustrate exemplary embodiments of the present invention.

DETAILED DESCRIPTION

Figure 2:
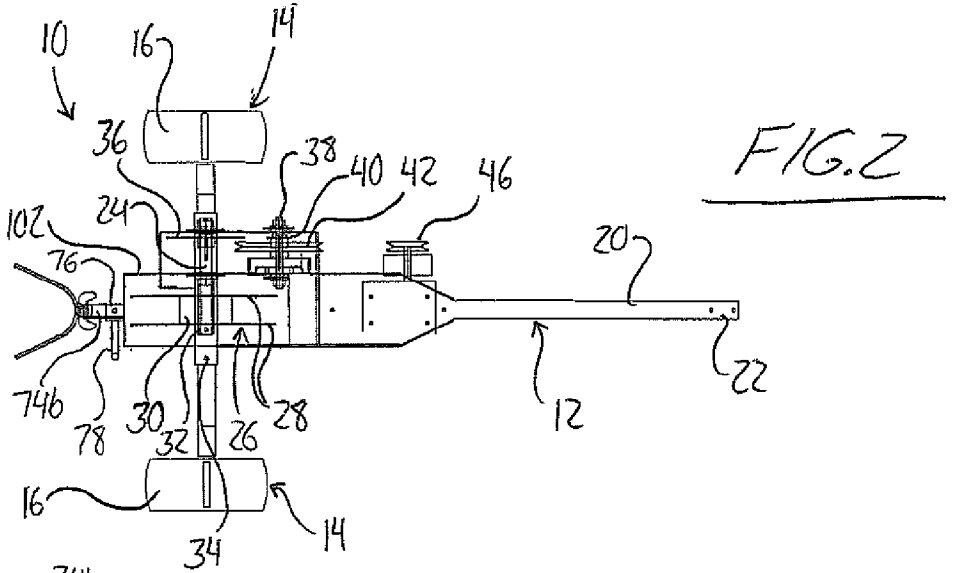
FIG. 2 is an overhead plan view of an apparatus like that of FIG. 1 with selected features removed for ease of illustration and visibility of drive components used to effect rotation of a fencing wire spool to retrieve wire previously deployed therefrom.
Figure 1:
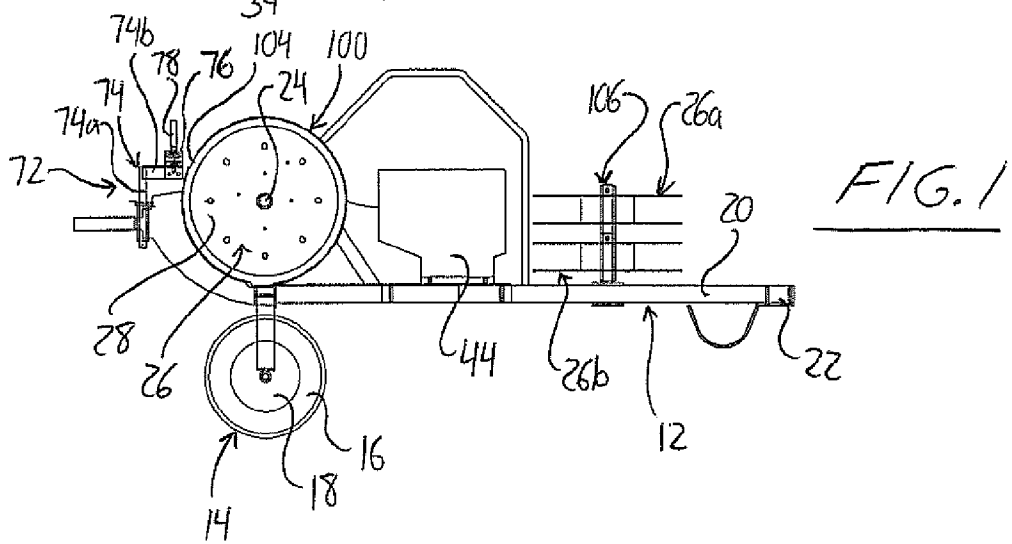
FIG. 1 is a side elevational view of an apparatus for deploying and retrieving fencing wire in accordance with the present invention.

FIGS. 1 and 2 show a trailer or carriage apparatus 10 for use in deploying and retrieving wire fencing. The apparatus 10 is intended for use with a towing vehicle, such as an all terrain vehicle (ATV). It will be appreciated that a truck or tractor or other suitable vehicle be substituted as needed or desired by a farmer or other operator. As may be seen in the drawings, the apparatus includes a carriage or trailer 12 which may have an open frame or alternatively employ a mesh or solid deck atop the frame members. The trailer is conventionally supported on a pair of wheels 14, which may be mounted on a common axle or on stub axles as may be convenient. Likewise, the wheels may be of any convenient nature, either balloon tires 16 on hubs 18 or other variations. A forwardly extending tongue 20 extends linearly along a central longitudinal axis or centerline of the trailer and is used to connect the trailer 12 to the towing vehicle with either a pin and clevis connection 22 as shown or a ball and cap connector as is well known.

At a position along the trailer's longitudinal axis near a rear end of the trailer opposite the tongue-carried hitch connection 22, and specifically directly overhead of the coincident rotational axes of the wheels of the illustrated embodiment, a spool support shaft 24 is rotatably supported at a height above the trailer frame to extend parallel to the wheels axes in a transverse direction perpendicular to the longitudinal axis of the trailer. The shaft 24 extends across the centerline of the trailer in order to rotatably support a spool 26 of fencing wire in a position over the centerline of the trailer. To removably install such a spool on the shaft, the spool is slid onto the shaft over a free end thereof to slide the shaft through aligned central holes in the two end plates 28 of the spool, and in doing so, through the hollow center of the round cylindrical drum 30 of the spool having its respective ends fixed concentrically to the end plates 28. In a conventional manner, the fencing wire is wound around the drum of the spool 26.

The spool features a length of round cylindrical tubing 32 passing centrally through both end plates to form a tubular passage passing the central holes therein for the sliding receipt of the support shaft in the mounting of the spool thereon. A diametrical hole 34 extends through the spool's central tube 32 adjacent one end of the tube to the outside of a respective one of the spool's end plates 28. In sliding of the spool onto the support shaft 24 from the free end thereof, the opposite end of the spool's central tube is pushed against a flange on the support shaft projecting outward therefrom past the internal diameter of the central tube, or against another stop element mounted proximate the shaft, so that the spool is stopped in a predetermined position along the shaft. In this predetermined position, hole 34 in the spool's central tube 32 is disposed at a position near the free end of the shaft, where a corresponding diametrical through hole is provided in the support shaft 24. With the spool fully slid onto the shaft into the predetermined position therealong, the spool is then rotated as needed about the support shaft axis to align the through hole 34 in the spool's central tube with the corresponding through hole in the support shaft. A locking pin (not shown) is then passed through these aligned holes to lock the spool onto the support shaft 24 to prevent both relative rotation about the shaft axis and relative sliding displacement along the shaft axis between the spool and the support shaft.

Adjacent an end of the support shaft 24 that is opposite the free end thereof and is disposed laterally outward from the centerline of the trailer where the spool is supported, a support shaft sprocket 36 is fixed on the support shaft 24. Forward of the spool support shaft 24, i.e. at position along the centerline of the trailer between the spool support shaft 24 and the trailer tongue 20, an intermediate drive assembly features a rotatable shaft 38 carried on the trailer frame in a position parallel to the spool support shaft 24 and projecting laterally outward away from the centerline of the trailer to the same side thereof as the spool support shaft to carry a smaller sprocket 40 near an outer end of the rotatable shaft 38 in a position aligned (i.e. coplanar) with the larger support shaft sprocket 36. Inwardly along the rotatable shaft 38 from the sprocket 36 fixed thereon, the intermediate drive assembly features a pulley 42 also fixed on the rotable shaft for rotation therewith.

Further forward along the trailer from the intermediate drive assembly is a rotational drive source provided by an internal combustion engine 44 mounted on the trailer frame in a fixed position on the centerline thereof and having its output shaft projecting laterally outward to the same side of the trailer as the rotatable shaft of the intermediate drive assembly and coupled to a smaller pulley 46 positioned in-line (i.e. coplanar) with the larger pulley 42 of the intermediate drive assembly. Although omitted from the figures for clarity and ease of illustration, a flexible chain is entrained about the two sprockets to interconnect the intermediate drive assembly and the spool support shaft, and a flexible belt is likewise entrained about the two pulleys to interconnect the engine and the intermediate drive assembly. With the pulley of the intermediate drive assembly being larger than the thereof sprocket, the output rotational speed of the engine is reduced once by the belt drive between the engine and the intermediate assembly, and then again by the chain drive between the intermediate assembly and the spool support shaft. The engine is operable in a direction to drive rotation of the fencing wire spool fixed on the support shaft 24 in a direction acting to wind previously deployed fencing wire back onto the spool.

A wire guide assembly 72 at the rear of the trailer apparatus 10 features an L-shaped support member 74 with a vertical leg 74*a* thereof supported at a position rearward of the spool for pivoting about a vertical axis. The horizontal leg 74*b* of the support member 74 projects horizontally from a top end of the vertical leg 74*a*. The vertical axis of the vertical leg 74*a* intersects the centerline of the trailer and the horizontal leg 74*b* lies in a central vertical plane of the trailer containing the centerline longitudinal axis thereof when the horizontal leg 74*b* is positioned to extend parallel to the trailer's centerline in a forward direction therealong. This vertical plane cuts centrally through the drum of the spool 26, and so the horizontal leg is centered on the spool drum in the aforementioned position projecting forwardly along the trailer's centerline. A hollow sleeve 76 mounted atop an end of the horizontal leg 74*b* opposite the vertical leg 74*a* at an elevation above the spool support shaft 24 and outside but proximate the circumference of the spool's end plates is axially parallel to the horizontal member in order to present an eyelet or hollow passage through which a length of wire partially wound on the spool can extend along the horizontal leg of the support member 74. A preferably zig-zagging, jagged, curved or sinusoidal slot extending end-to-end along a side of the sleeve provides an access opening through which wire can be inserted or removed from a position passing through the hollow interior of the sleeve without having to fish an end of the wire end-to-end through therethrough. An L-shaped handle 78 projects horizontally from one side of the horizontal leg 74*b* of the support member 74 in a direction perpendicular thereto and then vertically upward at a distance laterally outward therefrom. The handle is operable to manually pivot the L-shaped support member 74 about its vertical axis to move the sleeve 76 back and forth across the centerline through the vertical plane of the trailer to directing wire passing through the sleeve toward different positions between the end walls of the spool along the axis of the drum.

Figure 3:
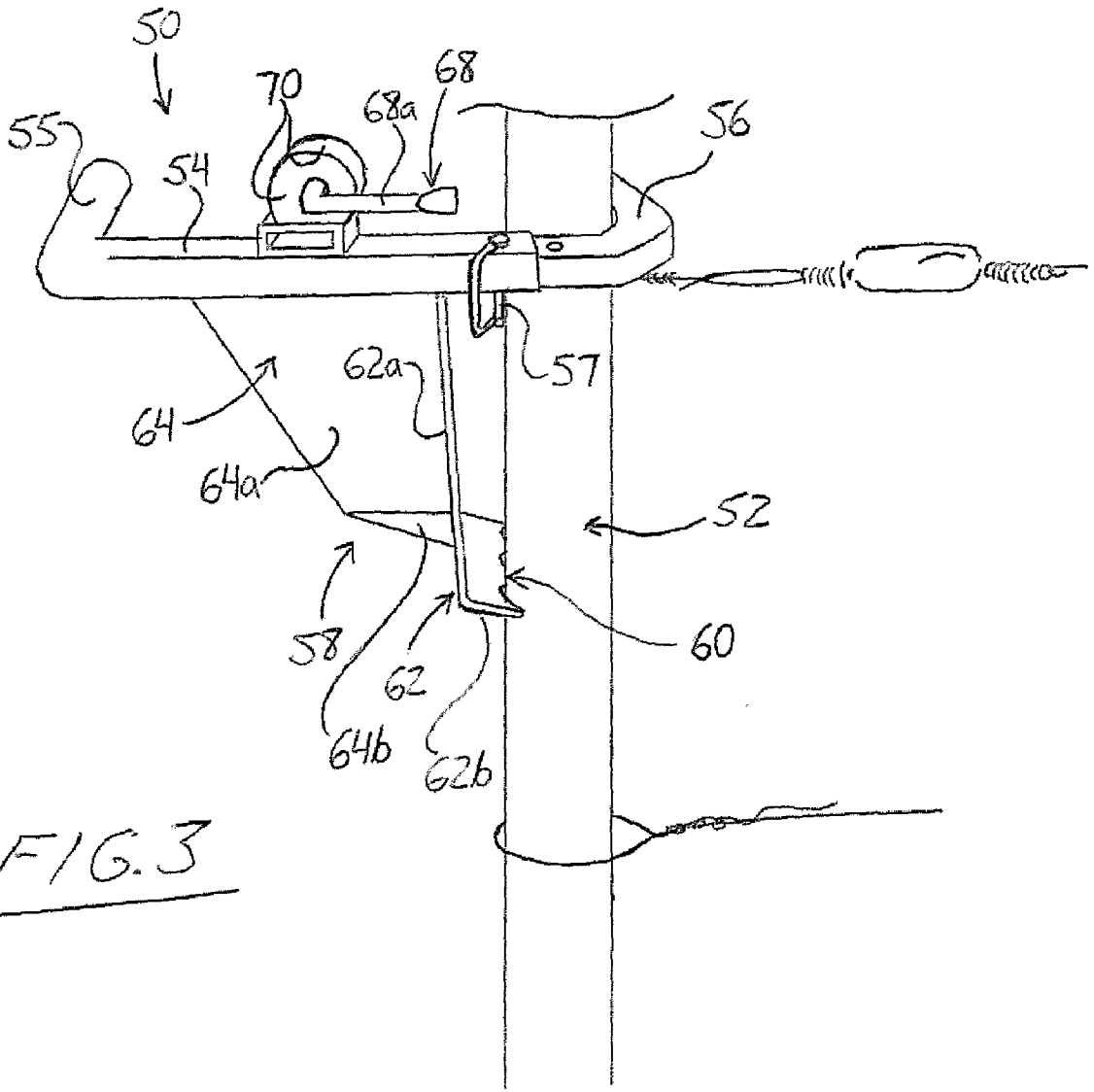
FIG. 3 a side perspective view of an apparatus for temporarily supporting a spool of fencing wire on a fencepost in accordance with the present invention.
Figure 4:
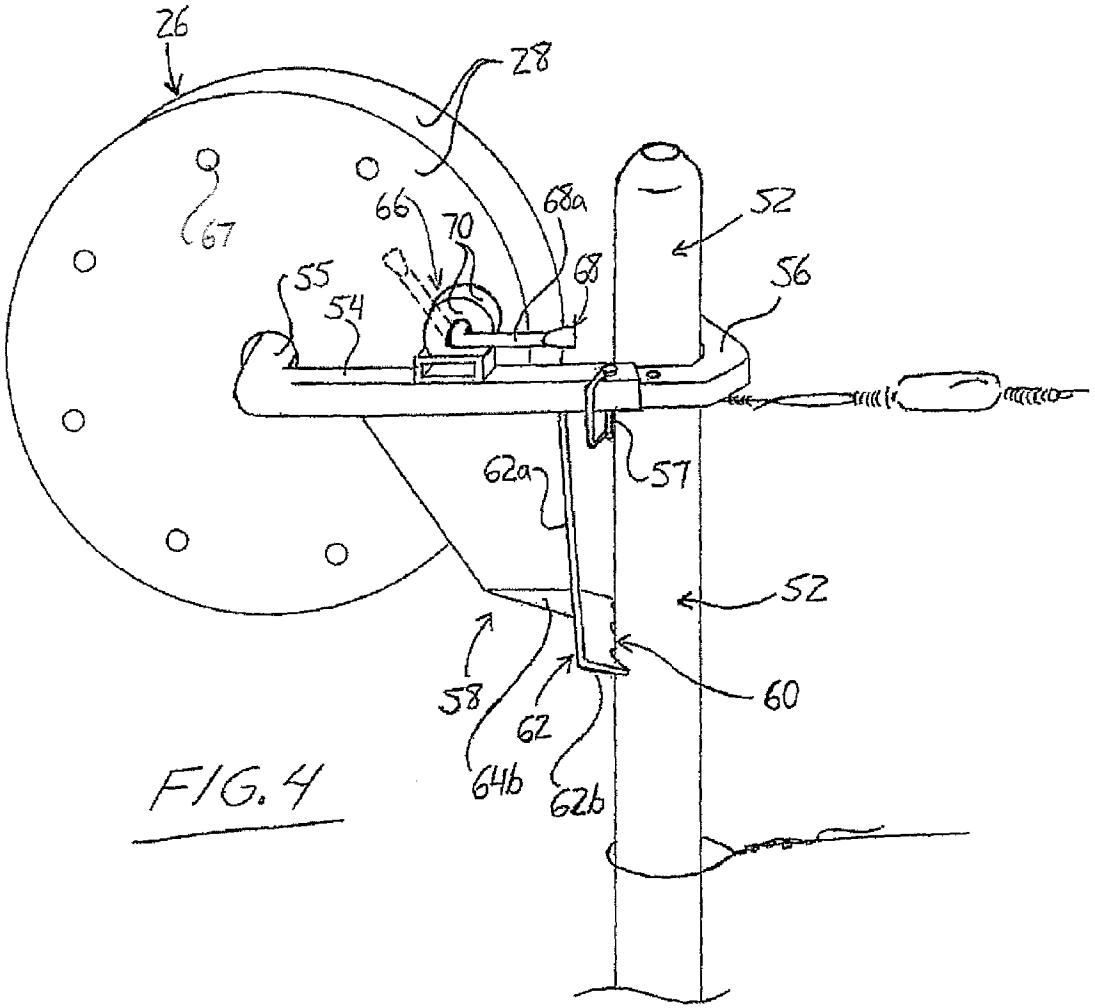
FIG. 4 is a side perspective view of the apparatus of FIG. 3 with a spool of fencing wire supported thereon.

Turning now to FIGS. 3 and 4, a further apparatus 50 useful with that of FIGS. 1 and 2 is shown. This second apparatus 50 is intended to temporarily support the aforementioned spool 26 of fencing material on a fencepost 52. The illustrated spool support 50 features a linear-extending arm 54 defined by a length of hollow rectangular tubing. A short shaft 55 of circular cross-section is fixed at one end of the tubular arm 54 in an orientation projecting perpendicularly away therefrom. The opposing end of the arm 54 is left open, and telescopically receives therein a linear portion of a cross sectionally smaller length of rectangular tubing having been bent into a hook-shaped or J-shaped configuration consisting of the linear portion and a U-shaped portion integral with an end of the linear portion to curve away from the linear portion and then back a partial distance therealong. The linear portion of the J-shaped piece 56 has a series of parallel through holes extending through it at spaced positions along its length, and a single corresponding through hole passes through the arm 54 near the end thereof in which the J-shaped piece 56 is telescopically received in a direction parallel to the multiple through holes in the J-shaped piece. Accordingly, the effective length of the arm 54 can be lengthened or shortened by sliding the J-shaped piece 56 further outward from or further into the arm 54, and the arm can be locked at the selected adjustable length by use of locking pin 57 passable through the hole in the arm 54 and a selected one of J-piece holes aligned therewith. As shown in FIGS. 3 and 4, installation of the spool support apparatus 50 on a fencepost 52 involves placing the J-shaped piece in a position embracing around one side of the post so that the arm 54 projects horizontally away from the post on the side thereof opposite where the J-shaped piece curves or bends partially about the post.

A brace arrangement 58 depends downward from the arm 54 to brace against the side of post opposite where the J-shaped piece embraces thereabout. More of the spool support's weight is distributed on the side of the post to which the arm projects when installed, thus tending to pull the shaft-equipped end of the arm downward relative to the J-shaped piece embracing about the post. However, this movement is blocked by the contact of the bracing arrangement 58 against the front of the post, and accordingly the J-shaped embracing member 56 and the bracing arrangement 58 cooperate to maintain the spool support in a position projecting the arm laterally from the post. To maintain the spool support's position along the height of the post, the bracing arrangement features teeth 60 that tend to pierce into the surface of a wooden fence post when forced against the periphery thereof to better grip the post and thus maintain a fixed position of the spool support 50 thereon.

The bracing arrangement of the illustrated embodiment features a first plate 62 transverse to the arm 54 and bent to have a generally L-shaped vertical cross section having a longer leg 62*a* of the L-shape depending downward from the arm, and a shorter leg 62*b* of the L-shape then extending away from the longer leg away from the shaft-carrying end of the arm 54. The more horizontal part of the first plate, defining the shorter leg of its L-shaped cross section, is cut at its distal end opposite the more vertical part to form the sharp teeth 60 or points to engage the fencepost. The first plate 62 extends further to the side of the arm 54 to which the J-shaped piece 56 curves than to the opposing side so that the fencepost is clamped between the toothed bracing arrangement and the J-shaped embracing member when the spool supporting apparatus is installed. To prevent the first plate 62 from bending or breaking off, a second plate 64 reinforces it. The second plate 64 features an upper part 64*a* fixed to the underside of the arm 54 on the same side of the first plate as the shaft 55 and lying in a vertical plane containing the central longitudinal axis 54 thereof. The second plate 64 is bent so that a lower part thereof 64*b* slopes obliquely downward from the top part 64*a* to the same side of the arm 54 as the shaft 55. Edges of the two parts of the second plate opposite the shaft 55 are fixed to the face of the first portion of the first plate depending downward from the arm 54 to better support the first plate in a fixed position relative to the arm.

The telescopic sliding of the J-shaped piece 56 within the arm 54 allows the distance by which the J-shaped piece extends from the end of the arm 54 to be adjusted, thereby allowing change of the distance between the curved or bent end of the J-shaped piece and the toothed edge of the bottom part of the bracing arrangement's first plate 62. Accordingly, the spool support apparatus 50 can be adjusted to accommodate fenceposts of varying sizes between the two engagement points provided by the J-shaped embracing member and the bracing plates, the apparatus therefore not being limited to use with a specifically sized fencepost.

Referring to FIG. 4, the central tube of the spool 26 of fencing wire can be slipped onto the shaft 55 of the spool supporting apparatus 50 to pass the shaft 55 through the central openings in the end plates 28 of the spool, the shaft 55 thereby rotatably supporting the spool 26. Although not shown, a cylindrical through-hole extending through the shaft 55 near the free end thereof opposite the arm 54 is included to receive a locking pin through it after installation of spool on the shaft to block any inadvertent sliding of the spool from off the free end of the shaft. A latch mechanism 66 is carried atop the arm 54 of the spool support 50 and is cooperable with circumferentially spaced holes 67 in the one of the spool's end plates 28 facing the arm 54 to lock the spool 26 in a fixed rotational position about the axis of the shaft 55. An L-shaped latch arm 68 has one leg thereof extending perpendicularly across the arm 54 through axially aligned holes in a pair of parallel plates 70 projecting upwardly away from the arm 54 adjacent opposite sides thereof. The first leg of the latch arm 68 is linearly displaceable along and rotatable on its lengthwise axis perpendicular to that of the arm. A spring coiling around the first leg of the latch arm 68 between the parallel plates 70 biases the first leg along its axis toward a first position projecting far enough from the arm 54 to engage into one of the holes in the end plate 28 of the spool lying on a circular path about the center thereof, such engagement blocking rotation of the spool about its central axis coincident with that of the shaft 55. To withdraw the latch arm from this locking position, for example to allow initial installation of the spool on the shaft 55 without interference by the latching mechanism, one uses the second leg 68*a* of the latch arm. The second leg of the latch arm 68 is disposed outside the parallel plates 70 on the side thereof opposite the side of the arm to which the shaft projects and extends radially outward from the first leg by a length sufficient to prevent the second leg from passing through the hole in the nearest one of the mechanism's parallel plates 70. The second leg can be used to pivot the first leg about its axis and pull the second leg therealong. A feature on the first cylindrical leg projects outward from the circular circumference of the first leg, but not around the full circumference thereof. The otherwise circular hole in the one of the parallel plates 70 nearest the side of the arm 54 to which the shaft 55 projects has a notch or slot extending outward from its otherwise circular periphery, and this notch or slot is shaped to accommodate passage therethrough of the projecting feature on the first shaft leg. The projecting feature on the first leg of the latch arm is disposed outside the parallel plates 70 of the latch mechanism on the side thereof to which the shaft 55 projects when the latch arm is in the locking position, while a retracted or unlocked position of the first leg of the latch arm positions the projecting feature between the parallel plates with the first leg no longer projecting far enough from the arm to reach into a hole in the spool's end plate. The first leg of the latch arm can only be displaced between the locking and unlocked positions when rotated about is own axis into a position in which the projecting feature aligns with the notch or slot at the periphery of the hole in the plate opposite the second leg of the latch arm. Using the second leg of the latch arm as a lever, pivoting or rotating the first leg into a position in which the projecting feature and notch/slot are not aligned, locks the latch arm into or out of the locking position depending on whether the projecting feature is between or outside the parallel plates.

A method of deploying a wire fence for temporary use and subsequently retrieving the fencing wire will now be described in terms of the apparatuses shown in the drawings.

A spool of fencing wire is mounted on the spool supporting shaft 24 of the trailer apparatus of FIGS. 1 and 2 as described above. Preferably a cylindrical housing 100 closes substantially around the support shaft and has a closed end 102 through which the support shaft passes, and a selectively openable and closeable door (not shown) at an opposite end outward from the free end of the support shaft, the installation of the spool thus preferably involving placement of the spool onto the support shaft through the open end of the housing, and subsequently closing and locking the housing door. The trailer apparatus is towed to a position along a boundary or perimeter of an area to be fenced in. A first or primary fencepost is erected at a first location along the perimeter if not done previously. The spool housing door is opened to access a free end of the fencing wire wound completely on the spool 26 and pass this free end of the wire through a slot-like opening 104 in the periphery of the cylindrical housing on a rear side of the housing opposite the engine 44. The free end of the fencing wire is attached to the primary fencepost in a conventional manner, for example using a gate handle. The towing vehicle is then driven along the perimeter of the area to be fenced to a position selected to mark the end of a section of fence using the particular spool from which the wire is being deployed, and the spool on the trailer is allowed to rotate on the spool support shaft during this transport to string out wire from the spool under the tension in the wire between the now-fixed end of the wire secured to the first fencepost and the remaining wire wound on the spool. In other words, the fence wire plays off the spool against the rotational resistance provided by the chain connection between the spool support shaft and the intermediate drive assembly and the belt connection between the intermediate drive assembly and the rotational drive source.

If not previously installed, another fencepost is erected at the section-end position, and the spool support apparatus 50 is installed on this post at a height above the ground from which it projects. The spool 26 is removed from the trailer apparatus 10 and installed on the spool support apparatus 50 so as now to be mounted on the final fencepost of the fence section. Initially, the spool 26 is installed on the fencepost with the latch mechanism in secured in an unlocked position so that the latch arm 68 does not engage the spool. The fence installer manually rotates the spool on the shaft 55 in a tightening direction increasing the tension of the fencing wire now strung out between the first and final fenceposts of the section. Upon tensioning of the wire by this rotation of the spool to a sufficient level to overcome slack that may have been introduced in transfer of the spool from the trailer to the final fencepost, the latch mechanism can then be deployed into the locking position to engage the spool and block any rotation thereof in either direction. The spool of wire is now fixed on the final fencepost and a portion of the length of wire that was originally fully wound on the spool is now deployed and tensioned between the first fencepost and the mounted position of the spool on the final fencepost, and can be coupled to a suitable energization source proximate the first fencepost for use as a section of temporary electrical fencing.

When it becomes time to remove or relocate the fencing wire, the energization source is first disconnected to deactivate the wire, and then the end of the wire is disconnected from the first fencepost. The latch mechanism is then manipulated into the unlocked position to release tension from the wire, at which point the spool of wire can then be removed from the post-mounted spool supporting apparatus 50, which in turn can then be removed from the fencepost. The spool is re-mounted on the trailer apparatus 10 to fix the spool to the spool supporting shaft on the trailer. Near where the previously deployed wire wraps onto the spool, the wire is grasped by the operator and manipulated into the sleeve 76 of the wire guide assembly using the slot in the side or top of the sleeve wall so that the previously deployed wire now passes through the eye or passage of the wire guide in its connection to the spooled remainder of the wire. The engine 44 of the trailer apparatus is then started and driven to rotate the spool support shaft 24 in the appropriate direction to re-wind the previously deployed fencing wire back onto the spool 26 through the wire guide and the rear opening in the spool housing. During this re-spooling or winding of the wire, the L-shaped handle 78 is moved back and forth across the center line of the trailer to lay sequential wraps of the wire around the drum of the spool immediately adjacent one another across the spool's drum, thereby cleanly winding the wire back onto the spool to prevent tangles and ensure the full length of wire will fit on the spool between, and inward from the outer perimeters of, the end plates thereof. The housing previously described as closing around the spool-supporting shaft contains the spool during this engine driven retrieval, and preferably the other moving parts at the engine output, intermediate drive assembly, spool-support shaft and connections therebetween are similarly substantially enclosed for operator safety.

Depending on the amount of wire on the spool and the size of the area to be fenced in, the wire may be used to produce a fully complete fence around the area or fully or partially along one or more sides of the area. While the wire from a single spool is being strung out between two end posts along a side of the area, an operator may stop at intermediate locations along the side to connect the wire to fenceposts at such intermediate locations, and such a fencepost may be installed at each such intermediate location if not previously having been so erected. Alternatively, to form a single-side section of fence, one may drive in a substantially straight line from a first primary post at which the free end of the wire has been connected to an intended end-post site, hang the spool at the end post, tension the wire and then go back and fill in intermediate posts along the tensioned wire and couple the wire to these intermediate posts. If wire from a single spool is being used to form fencelines on two sides of the desired area, of course at least one intermediate post must be erected to have the wire engage therewith to define the corner between the two sides to be fenced. The present invention also extends to multi-wire fences, were multiple wires extend one over the other at spaced elevations along the fenceposts. That is, two, or possibly even more depending on the height of the fenceposts, spools may be mounted on a single end-post of a desired fence section using multiple spool support apparatuses or an alternative embodiment spool support apparatus modified from the single-shaft configuration shown to allow support of multiple spools using one apparatus.

As demonstrated in FIG. 1, the trailer apparatus may feature one or more spool storage units such as the illustrated upright post 106 projecting vertically upward from the horizontal trailer frame at the tongue 20 and having a diameter sufficiently small for the sliding of one or more spools 26*a*, 26*b* over the free top end of the post to lie each spool horizontally over the trailer frame. The trailer apparatus may likewise incorporate one or more units for storing one or more of the spool supports 50 on the trailer. This way, multiple sections of fencing can be deployed in a single outing of the trailer without having to travel to and from an equipment storage location between wiring of multiple sections.

In an alternate unillustrated embodiment of the trailer apparatus, the handle for operating the wire guide is relocated to a position forward of the spool housing and rearward of the engine. The handle is coupled to the support member 74 of the wire guide through a suitable link or linkage to allow the same operator control over back and forth movement of the eye of the wire guide across the centerline of the trailer about the support member's pivotal axis. An electrically powered shaft brake operable on the shaft of the intermediate drive assembly and an electrically powered clutch operable to couple and decouple rotation of the engine output shaft and the drive pulley are operated by an on-board battery of an electrical system charged by operation of the engine. The electrical system is manually activated, for example using a key ignition, before becoming operational to power any equipment on the trailer. With the ignition control actuated to activate the electrical system, the electric brake takes on a powered normally-on condition to prevent rotation of the intermediate shaft, and accordingly prevent rotation of the spool support shaft coupled thereto by the chain, and the electronic clutch initially remains in a normally-disengaged condition in which driving connection between the engine's output shaft and the drive pulley is decoupled. A normally open momentary switch button on the wire guide control handle and another normally open momentary switch button at another location on the trailer in a position accessible by the operator when standing beside the trailer to operate the wire guide control handle are wired with the electrical system such that must both be depressed in order for the electric brake to be released and the electric clutch to be engaged. Accordingly, the drive pulley, the intermediate drive components and the spool support shaft components will only begin to move to wind the previously deployed fencing wire back onto the spool when both of the operator's hands are known to be in safe positions spaced sufficiently far from these components. If during driven operation, either "dead man's switch" is released by the operator, the clutch will disengage and the brake will activate to cease driven wire-retrieving operation of the apparatus. When the trailer is being used to deploy fencing, the ignition is left off, and accordingly the brake is left unpowered and accordingly does not act on the intermediate shaft. With the brake inactive, the intermediate shaft and therefore the spool support shaft are allowed to rotate to play out fencing wire from the spool during driving of the vehicle after previous attachment of the wire's free end to a fencepost.

Although not shown, some embodiments may feature an operator actuable throttle control to giver the operator control over the output speed of the engine or motor and accordingly control the rotational speed of the spool and resulting retrieval time of the wire.

The present invention, encompassing both methods for, and apparatuses useful in, deployment of wire fencing for temporary use, provides improvement over prior art techniques and equipment by avoiding the need to cut wire and subsequently rejoin it to a spool for retrieval. Wire is easily and quickly deployed by merely mounting a spool on the trailer, driving it along the intended fenceline and then mounting it on an end-post of the desired fence section. Subsequent retrieval of the fencing wire is likewise quick and simple, requiring only disconnection of the wire, relocation of the spool from the fencepost to the trailer and operation of the engine to re-spool the previously deployed wire.

It should be appreciated that many possible variations of the embodiments detailed herein above will fall within the scope of the present invention. For example, although the fence deploying and retrieving apparatus is described in terms of a trailer vehicle to be towed by a powered vehicle, it may alternatively be produced as a stand-alone self-powered vehicle or possibly an attachment apparatus arranged to be carried on an existing vehicle. Additionally, the internal combustion engine may be replaced with another drive source, for example a hydraulic or electric motor to be powered by a hydraulic or electrical system of a suitably equipped towing vehicle. Alternatively, the wire deploying and retrieving apparatus may rely on manual rotation of the spool and forgo a fuel driven or hydraulically or electrically powered drive source, for example by having a crank-equipped spool rotatable about a fixed support shaft or again locking a spool to a rotatable shaft operable by a manual crank on the apparatus.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of deploying fencing for temporary use, the method comprising the following steps:

(a) connecting a first end of a length of fencing wire wound on a spool to a first fencepost at a first position along a perimeter of an area to be bordered by the fencing;

(b) with the spool supported on a vehicle and rotatable about a rotational axis of the spool, driving the vehicle away from the first position toward a second position along the perimeter of the area, during which the spool being is pulled away from the first fencepost and rotates on the vehicle to deploy fencing wire from the spool for suspension at a height above ground between the first fencepost and the spool;

(c) removing the spool from the vehicle; and (d) mounting the spool on a second fencepost at the second position along the perimeter of the area to suspend the deployed fencing wire between the first fencepost and a mounted position of the spool on the second fencepost.

2. The method of claim 1 further comprising the following additional steps:

(e) leaving the deployed fencing in place suspended between the first fencepost and the mounted position of the spool on the second fencepost for a period of use;

(f) disconnecting the first end of the length of fencing wire from the first fencepost; and (g) rotating the spool in a direction opposite to that in which the spool was rotated in step (b) to wind the deployed fencing back onto the spool.

3. The method of claim 2 wherein step (g) comprises mounting the spool onto a vehicle-supported shaft on the vehicle with the rotational axis of the spool coincident with an axis of the vehicle-supported shaft and rotating the spool about the axis of the vehicle-supported shaft.

4. The method of claim 3 wherein the vehicle-supported shaft is a driven shaft and step (g) comprises mounting the spool on the shaft in a fixed position thereon to prevent relative rotation between the spool and the vehicle-supported shaft and then driving rotation of the vehicle-supported shaft to drive rotation of the spool.

5. The method of claim 4 wherein the vehicle comprises a rotational drive source operable to drive rotation of the vehicle-support shaft.

6. The method of claim 1 wherein step (d) comprises mounting the spool onto a fencepost-supported shaft on the second fencepost with the rotational axis of the spool coincident with an axis of the fencepost-supported shaft, rotating the spool about the axis of the fencepost-supported shaft in a same direction about the rotational axis of the spool as in step (b) to tension the deployed fencing wire between the first fencepost and the mounted position of the spool on the second fencepost, and locking the spool in a fixed position about the axis of the fence-supported shaft.

7. The method of claim 6 wherein the fence-post supported shaft is defined by a releasable spool support detachably mounted to the second fencepost.

8. The method of claim 7 wherein the spool support comprises a locking mechanism operable to selectively lock to the spool in the fixed position about the axis of the fence-supported shaft.

9. The method of claim 7 comprising carrying multiple spool supports on the vehicle for use in deployment of multiple sections of fencing between respective pairs of fenceposts.

10. The method of claim 1 wherein the vehicle comprises a towable trailer.

11. The method of claim 10 wherein the towable trailer is pulled by an ATV.

12. The method of claim 1 comprising carrying multiple spools of fencing wire on the vehicle for use in deployment of multiple sections of fencing each between a respective pair of fenceposts.

* * * * *